US007530642B2

(12) United States Patent
Ferreri et al.

(10) Patent No.: US 7,530,642 B2
(45) Date of Patent: May 12, 2009

(54) CUTTING BIT WITH SPLIT WEAR RING AND METHOD OF MAKING SAME

(75) Inventors: Scott Glenn Ferreri, Duncansville, PA (US); Wayne H. Beach, Roaring Spring, PA (US)

(73) Assignee: Kennametal Inc., Latrobe, PA (US)

( * ) Notice: Subject to any disclaimer, the term of this patent is extended or adjusted under 35 U.S.C. 154(b) by 242 days.

(21) Appl. No.: 11/639,463

(22) Filed: Dec. 15, 2006

(65) Prior Publication Data

US 2008/0143168 A1 Jun. 19, 2008

(51) Int. Cl.
*E21C 35/18* (2006.01)

(52) U.S. Cl. ..... 299/104

(58) Field of Classification Search ..... 299/104
See application file for complete search history.

(56) References Cited

U.S. PATENT DOCUMENTS

| | | | | |
|---|---|---|---|---|
| 4,725,098 | A * | 2/1988 | Beach | 299/105 |
| 5,417,475 | A | 5/1995 | Graham et al. | |
| 6,196,636 | B1 | 3/2001 | Mills et al. | |
| 6,709,065 | B2 | 3/2004 | Peay et al. | |
| 6,739,327 | B2 | 5/2004 | Sollami | |
| 6,758,530 | B2 | 7/2004 | Sollami | |
| 2003/0052530 | A1 * | 3/2003 | Sollami | 299/111 |
| 2003/0141753 | A1 * | 7/2003 | Peay et al. | 299/111 |
| 2005/0035649 | A1 | 2/2005 | Mercier et al. | |

FOREIGN PATENT DOCUMENTS

| | | |
|---|---|---|
| DE | 101 63 717 C1 | 5/2003 |
| GB | 2 004 315 A | 3/1979 |

* cited by examiner

*Primary Examiner*—John Kreck
(74) *Attorney, Agent, or Firm*—Matthew W. Smith

(57) ABSTRACT

The present invention provides a rotary cutting bit for use in road milling, mining and/or excavating applications that includes a split wear ring which is harder than the steel cutting bit body. The cutting bit has a cutting tip made of hard material such as tungsten carbide brazed into a nose portion of the steel tool body. The split wear ring is positioned in an annular channel in the tool body near the steel nose of the tool body. In one embodiment, the split wear ring is positioned so that the inner diameter of the split wear ring is smaller than the outer diameter of the cutting tip. Such a configuration allows the split wear ring to be tucked under the outer diameter of the cutting tip, decreasing tool body wear that could otherwise occur, thus providing longer tool life and reduced operating costs. The split wear ring pieces may be retained in place by a retainer such as banding rings, epoxies, tape or wire. Such retainers hold the ring sections in place during the assembly operation, so the ring sections do not move and remain attached to the tool body.

37 Claims, 7 Drawing Sheets

BEFORE TEST

RP36 SPLIT CARBIDE WEAR RING

RP36 HARDFACE

RP34

AFTER TEST

CUTTING BIT WITH SPLIT WEAR RING AND METHOD OF MAKING SAME

FIELD OF THE INVENTION

The present invention relates to road milling, mining and excavating tools, and more particularly relates to cutting bits with wear rings that reduce wear of such tools.

BACKGROUND INFORMATION

Cutting bits are used in various road milling, mining and excavating operations. The bits are mounted on a support structure such as a rotary drum. Each bit typically has a hard wear resistant tip made of a material such as tungsten carbide attached to a generally conical steel head of the bit. A problem with such designs is that the softer steel backing material erodes during cutting operations.

Wear resistant cutting bits have been developed in order to increase erosion resistance. For example, U.S. Pat. No. 4,725,098 to Beach discloses the deposition of a hard facing material on the steel nose of a tool body. U.S. Pat. No. 5,417,475 to Graham et al. discloses the installation of a ring of hard material on the front surface of a steel nose surrounding the hard cutting tip of a cutting tool. U.S. Pat. No. 6,709,065 to Peay et al. discloses the use of an annular ledge of hard material mounted near the steel nose of a cutting tool. Published U.S. Application No. 2005/0035649 to Mercier et al. discloses the installation of hard wear rings on a stepped shoulder of a cutting bit body. Despite these known designs, a need still exists for cutting bits which exhibit improved wear resistance.

SUMMARY OF THE INVENTION

The present invention provides a rotary cutting bit for use in road milling, mining and/or excavating applications that includes a split wear ring which is harder than the steel cutting bit body. The cutting bit has a cutting tip made of hard material such as tungsten carbide brazed into a nose portion of the steel tool body. The split wear ring is positioned in an annular channel in the tool body near the steel nose of the tool body. In one embodiment, the split wear ring is positioned so that the inner diameter of the split wear ring is smaller than the outer diameter of the cutting tip. Such a configuration allows the split wear ring to be tucked under the outer diameter of the cutting tip, decreasing tool body wear that could otherwise occur, thus providing longer tool life and reduced operating costs. The split wear ring pieces may be retained in place by a retainer such as banding rings, epoxies, tape or wire. Such retainers hold the ring sections in place during the assembly operation, so the ring sections do not move and remain attached to the tool body.

An aspect of the present invention is to provide a cutting bit comprising a body having a nose and a shank, a cutting tip mounted on the nose of the body comprising a harder material than the body, and a split wear ring mounted in an annular channel in the body adjacent the nose comprising a harder material than the body, wherein the split wear ring has an inner diameter less than an outer diameter of the cutting tip.

Another aspect of the present invention is to provide a cutting bit comprising a body having a nose and a shank, a cutting tip mounted on the nose of the body comprising a harder material than the body, a split wear ring mounted on the body adjacent the nose comprising a harder material than the body, and a retainer ring surrounding at least a portion of the split wear ring.

A further aspect of the present invention is to provide a cutting bit assembly comprising a body having a nose and a shank, a cutting tip mounted on the nose of the body comprising a harder material than the body, a split wear ring mounted in an annular channel in the body adjacent the nose comprising a harder material than the body, and a retainer ring surrounding at least a portion of the split wear ring for maintaining the split wear ring in the annular channel.

Another aspect of the present invention is to provide a method of assembling a cutting bit. The method comprises providing a body having a nose and a shank, mounting a cutting tip on the nose of the body comprising a harder material than the body, positioning a split wear ring in an annular channel in the body adjacent the nose comprising a harder material than the body, and securing the split wear ring in the annular channel.

These and other aspects of the present invention will be more apparent from the following description.

BRIEF DESCRIPTION OF THE DRAWINGS

As shown in FIG. 15, the cutting bit of the present invention exhibits significantly improved erosion resistance in comparison with the other designs.

DETAILED DESCRIPTION

Figure 1:
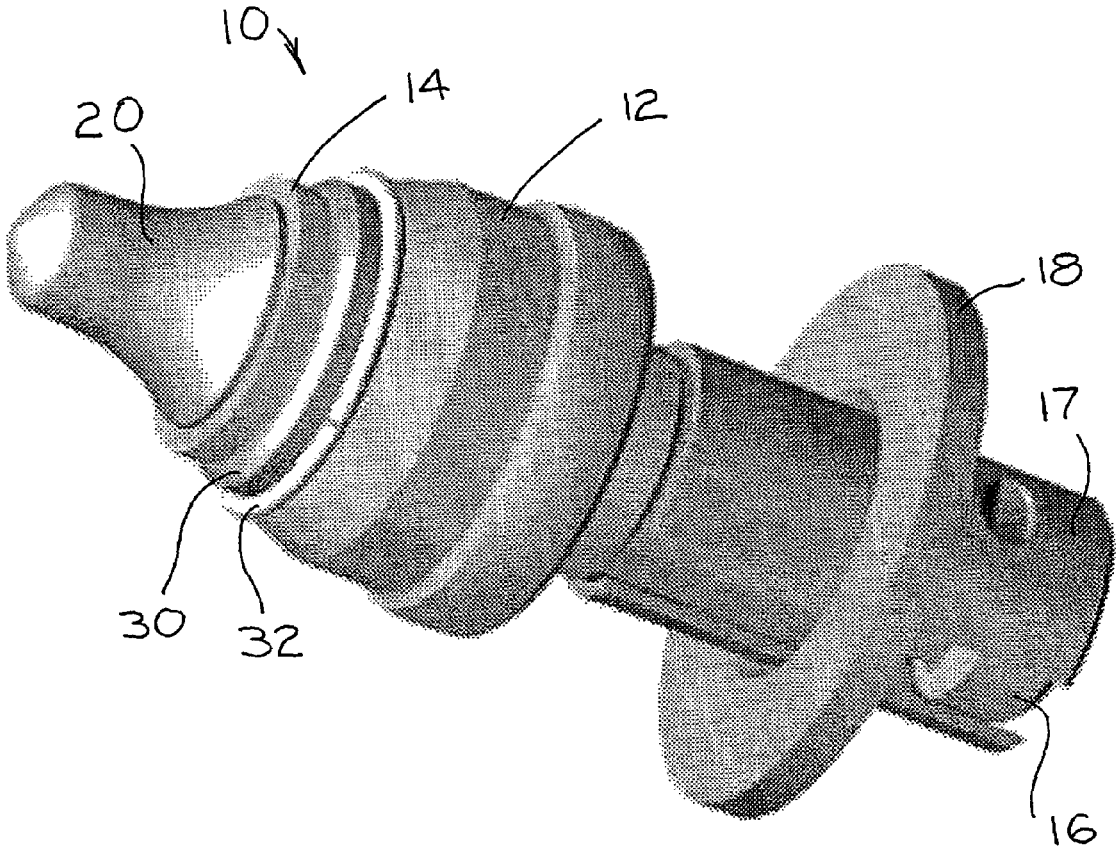
FIG. 1 is an isometric view of a cutting bit with a split wear ring and retaining ring in accordance with an embodiment of the present invention.
Figure 2:
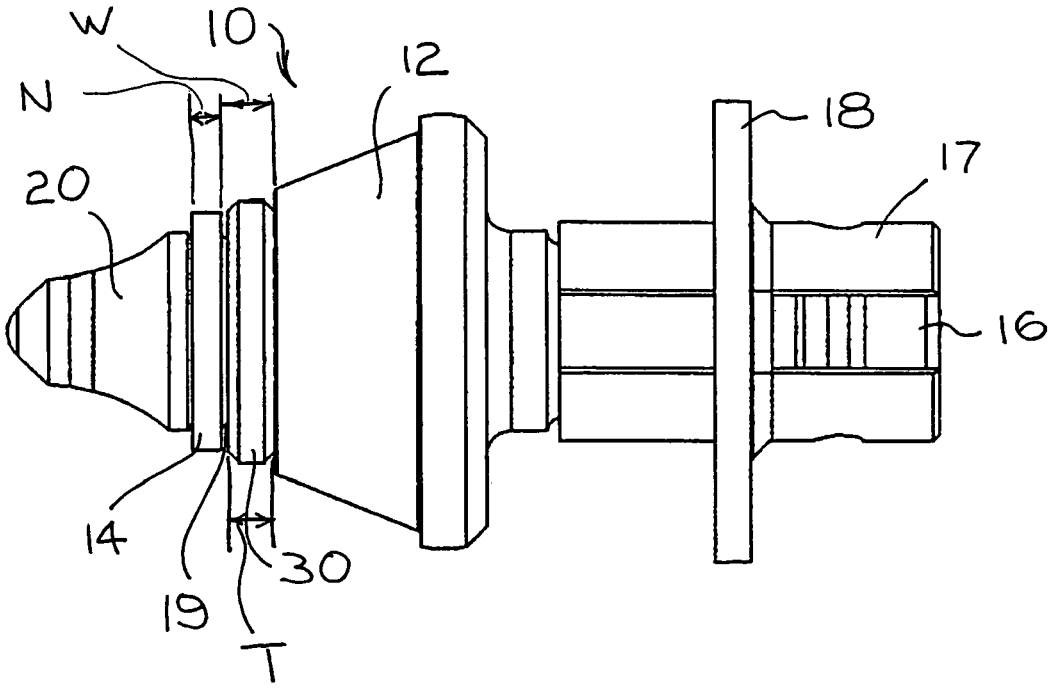
FIG. 2 is a side view of a cutting bit with a split wear ring in accordance with an embodiment of the present invention.
Figure 3:
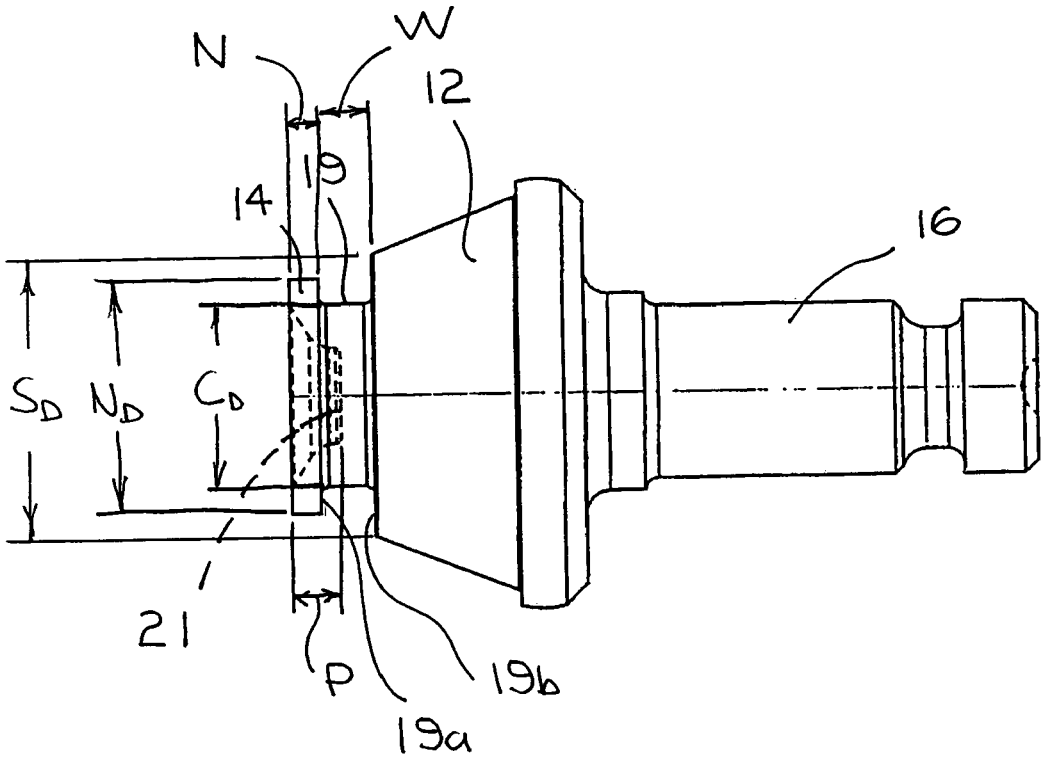
FIG. 3 is a side view of the body portion of the cutting bit of FIG. 2 with the cutting tip, split wear ring and retaining ring removed.
Figure 4:
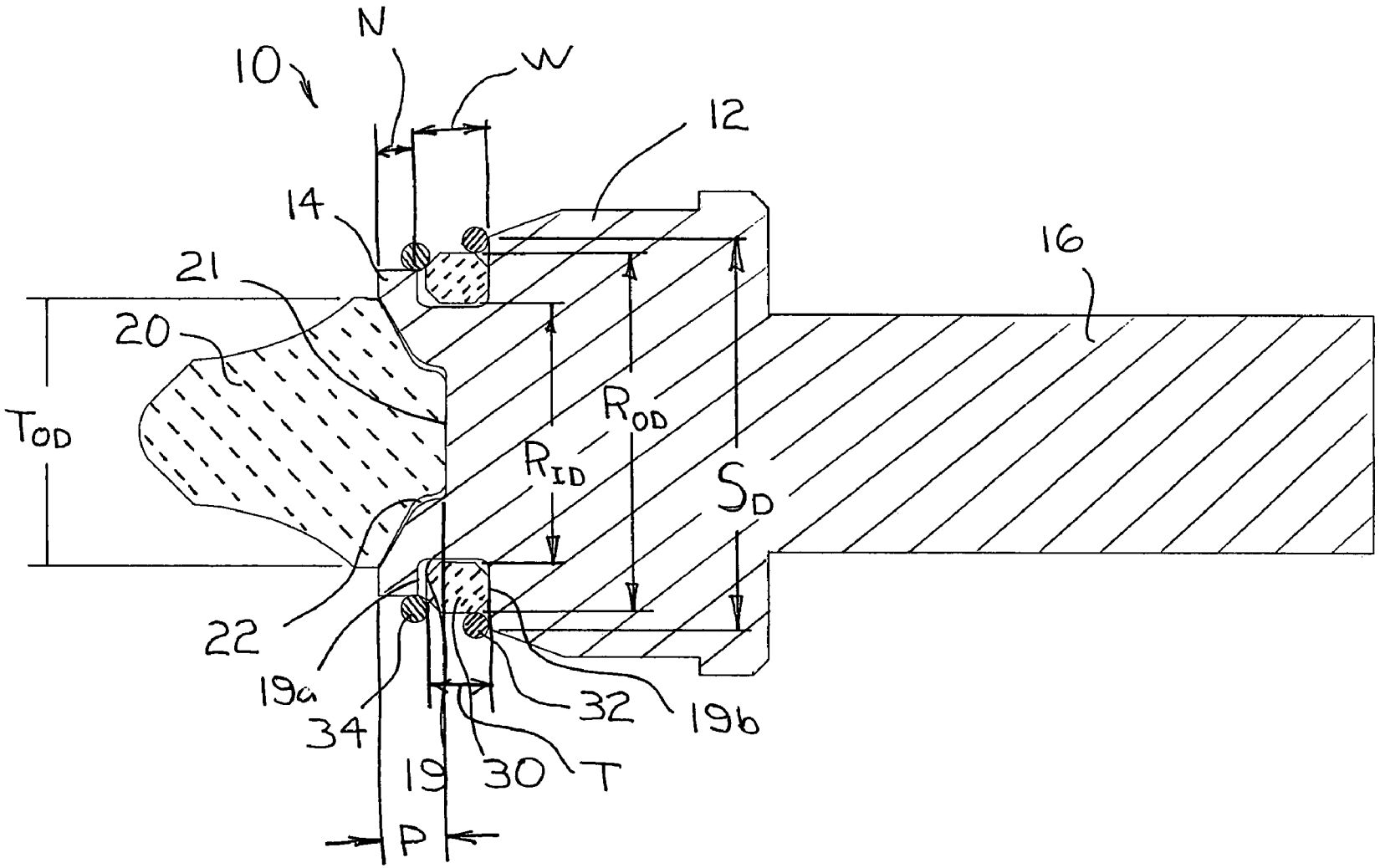
FIG. 4 is a longitudinal sectional view of a cutting bit assembly including a split wear ring, retainer ring and braze ring in accordance with an embodiment of the present invention.

As shown in FIGS. 1, 2 and 4, a cutting bit 10 comprises a body 12 having a front nose 14 and rear shank 16. The body 12 is typically made of steel. As shown most clearly in FIGS. 1 and 2, a spring sleeve 17 may be installed around the shank 16 of the cutting bit 10, and a washer 18 may surround the spring sleeve 17. A cutting tip 20 is mounted in a pocket 21 in the nose 14 of the cutting bit body 12 by known methods such as brazing or epoxy. The pocket 21 extends longitudinally from the front surface of the nose 14 into the body 12 a distance P, shown in FIGS. 3 and 4. The cutting tip is made of a relatively hard material, such as tungsten carbide, polycarbonite diamonds, ceramics, or any other material that is harder than the steel body.

As shown most clearly in FIGS. 2-4, an annular channel 19 is provided in the body 12 of the cutting bit near the nose 14. The annular channel 19 has a front wall 19*a* and a rear wall 19*b*, defining a width W of the annular channel 19. In the embodiment shown in FIGS. 2-4, the front and rear walls 19*a* and 19*b* are generally flat and extend in planes perpendicular to the axial direction of the cutting bit body 12. However, other wall surfaces, shapes and orientations may be used. For example, curved or faceted wall surfaces may be used instead of the flat wall surfaces shown in the figures. Furthermore, the walls may be oriented at angles other than perpendicular to the axial direction as shown in the figures. The annular channel 19 also has a diameter $C_D$ that is less than a diameter $N_D$ of the nose 14.

Figure 7:
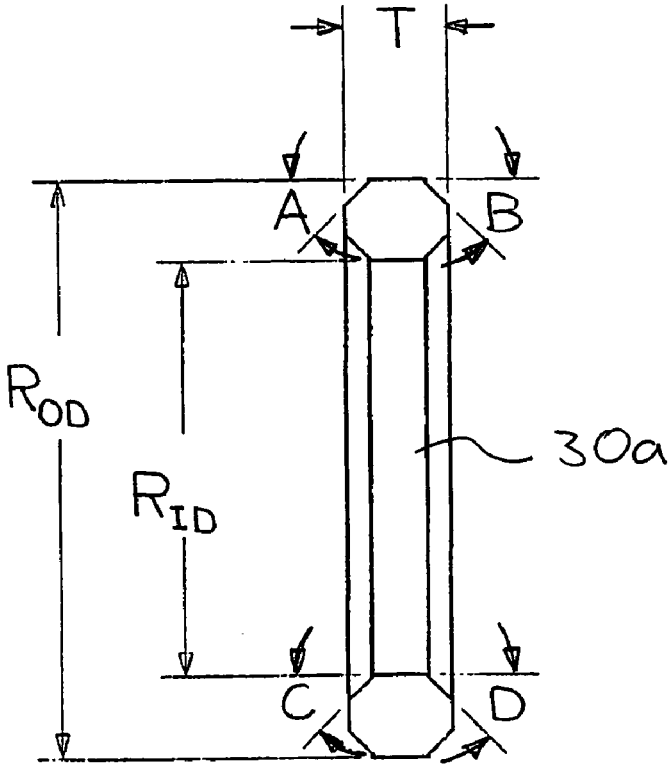
FIG. 7 is a side view of the split wear ring segment of FIG. 5.

In accordance with the present invention, a split wear ring 30 is provided in the annular channel 19. The hardness, size and location of the split wear ring 30 are selected in order to significantly reduce erosion and wear of the relatively soft body 12 of the cutting bit 10. The split wear ring 30 has an outer diameter $R_{OD}$, inner diameter $R_{ID}$, and thickness T, as shown in FIGS. 2, 4 and 7. The split wear ring 30 may be made of any suitable hard material such as carbides, aluminum oxide, hard ceramic materials, hardened tool steels and the like. For example, the split wear ring 30 may be made of tungsten carbide. In one embodiment, the split wear ring 30 and cutting tip 20 are made of the same hard material. Furthermore, portions of the split wear ring 30 may be made of different materials, e.g., materials having different hardness and/or toughness properties, graded materials, and the like.

The distance N between the front surface of the nose 14 and the front wall 19*a* of the annular channel 19 in which the split wear ring 30 is installed is minimized in order to provide improved wear resistance. For example, the distance N may be less than or equal to the width W of the annular channel 19, and may be less than or equal to the thickness T of the split wear ring 30. The distance N, width W of the annular channel 19 and thickness T of the split wear ring 30 are selected in order to provide the desired wear resistance for the body 12. In one embodiment, the distance N may be from about 0.05 to about 0.5 inch, the width W of the annular channel 19 may be from about 0.1 to about 0.3 inch, and the thickness T of the split wear ring 30 maybe from about 0.1 to about 0.3 inch.

As shown most clearly in FIGS. 3 and 4, the annular channel 19 and pocket 21 are arranged such that the distance P which the pocket 21 extends axially into the body 12 from the front surface of the nose 14 is greater than the distance N between the front surface of the nose 14 and the front wall 19*a* of the annular channel 19. In the embodiment shown in the figures, the distance P is such that the rear surface of the pocket 21 is located between the front wall 19*a* and the back wall 19*b* of the annular channel 19 in the axial direction of the body 12. Thus, the annular channel 19, and the split ring 30 mounted therein, surround the rear surface of the pocket 21 and the rear face of the cutting tip 20 mounted in the pocket.

As shown in the embodiment of FIGS. 1 and 4, a retainer ring 32 is used to secure the split wear ring 30 within the annular channel 19 of the body 12. The retainer ring 32 may be made of any suitable material such as spring steel, stainless steel, or any other material capable of withstanding the assembly attachment process for the split wear ring and cutting tip. As more fully described below, the retainer ring 32 is used to hold the split wear ring 30 in place during assembly of the cutting bit 10, and may be retained on the cutting bit 10 after it has been fabricated.

As shown in the embodiment of FIG. 4, a braze ring 34 may be positioned adjacent to the split wear ring 30 and the nose 14 of the cutting bit body 12 during fabrication of the cutting bit 10. The assembly shown in FIG. 4 may be heated by any suitable means such as induction heating to melt the braze ring 34 to form a braze joint between the split wear ring 30 and the annular channel 19 of the body 12. A braze alloy 22 may also be provided between a recess in the nose 14 of the body 12 and the rear portion of the cutting tip 20. In one embodiment, the braze joint 22 is formed during the same heating step which melts the braze ring 34 to form the joint between the split wear ring 30 and the body 12. The braze ring 34 and the braze joint 22 may be made of any suitable braze alloys such as high or low temperature copper based alloys. In one embodiment, the same braze alloy is used for the braze ring 34 and braze joint 22. In an alternative embodiment, epoxy may be used to secure the split wear ring 30 in the annular channel 19.

As shown in FIG. 4, the inner diameter $R_{ID}$ of the split wear ring 30 is smaller than an outer diameter $T_{OD}$ of the cutting tip 20. This arrangement provides significantly improved wear resistance by preventing steel wash more effectively. The inner diameter $R_{ID}$ of the split wear ring 30 is also smaller than the diameter $N_D$ of the nose 19. The location of the split wear ring 30 in the annular channel 19 a relatively close distance N to the nose 14 of the tool body 12 provides significantly better wash protection. If the split wear ring 30 was not tucked under the nose 14 of the tool body 12, it would rub in the cut due to its close proximity to the cutting tip 20, causing decreased wear protection and tool performance. The outer diameter $R_{OD}$ of the split wear ring 30 is also smaller than a diameter $S_D$ of a shoulder of the body 12. The shoulder diameter $S_D$ is measured at the edge where the rear wall 19*b* of the channel 19 meets the generally frustoconical portion of the cutting bit body 12. The smaller outer diameter $R_{OD}$ of the split wear ring 30 in comparison with the larger diameter $S_D$ of the tool body shoulder prevents the outside edge of the split wear ring 30 from rubbing in the cut.

With the split wear ring 30 located relatively close to the tool body nose 14, the steel body 12 is better protected and it holds its original conical shape, creating less drag and reducing operating costs. If the wear ring was moved further down the body 12, it would tend to blunt or become club-like during operation, slowing the machine down and increasing operating costs. The position of the split wear ring 30 in the upper portion of the body 12 can help aid in rotation by acting as a "steering wheel" in the cut. Thus, in addition to decreasing the body wear under the cutting tip 20, the split wear ring 30 attached to the cutting tool body 12 can also aid in tool rotation, lessen cutting bit frictional forces in the cut of the material, and reduce operating costs. The split wear ring may optionally include features such as ribs, flutes, veins and/or dimples for aiding in tool rotation.

Figure 5:
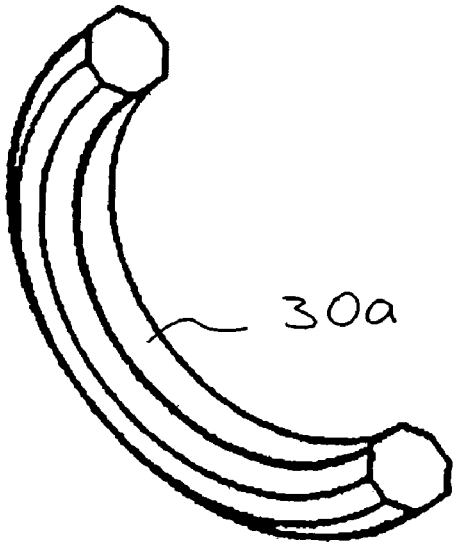
FIG. 5 is an isometric view of a split wear ring segment in accordance with an embodiment of the present invention.
Figure 6:
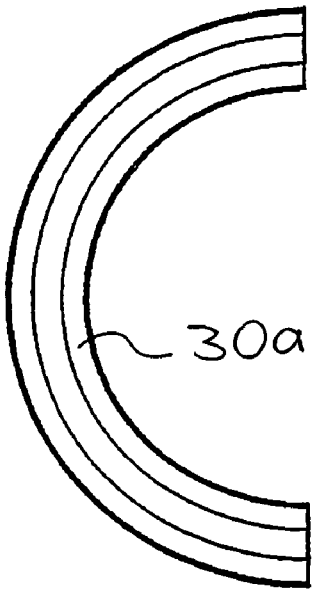
FIG. 6 is a front view of the split wear ring segment of FIG. 5.

Details of a split wear ring section 30*a* are shown in FIGS. 5-7. In this embodiment, two of the split wear ring sections 30*a* are used to form the split wear ring 30. However, any other suitable member of split wear ring sections may be used, such as three sections, four sections, etc. When the split wear ring sections are assembled in the annular channel 19, they may have flat faces which abut each other as shown in the embodiment of FIGS. 5-7. Alternatively, the abutting faces may have other shapes such as tabs or other features which provide a contoured or interlocking connection between adjacent sections.

In the embodiment shown in FIG. 7, the split wear ring 30 has a cross section with beveled corners forming angles A, B, C and D. In accordance with one embodiment, angles A and B are the same, and angles C and D are the same, such that the ring forms a mirror image and is symmetrical in a plane of the ring. Such a configuration facilitates assembly of the cutting bit 10 because when the split wear ring segments are mounted in the annular channel 19, they are automatically aligned with the opposing split wear ring segment(s). In one embodiment, all of the angles A, B, C and D are the same. Each of the angles A, B, C and D typically range from about 30 to 60 degrees, with an angle of about 45 degrees being particularly suitable. The symmetrical shape allows universal fit in assembly operations, such that no particular orientation is required when fitting the parts.

Figure 10:
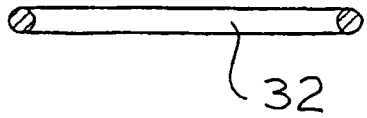
FIG. 10 is a sectional view taken through section 10-10 of FIG. 9.
Figure 8:
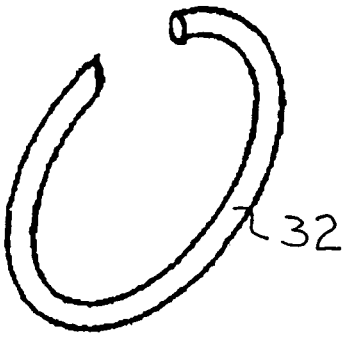
FIG. 8 is an isometric view of a retainer ring for securing a split wear ring on a cutting bit in accordance with an embodiment of the present invention.
Figure 9:
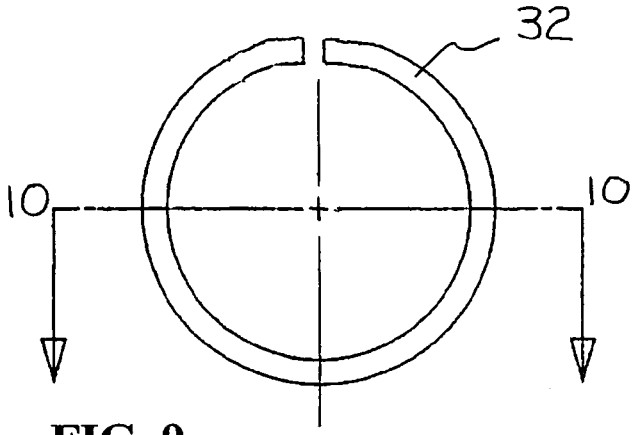
FIG. 9 is a front view of a retainer ring in accordance with an embodiment of the present invention.
Figure 13:
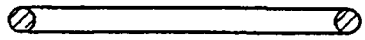
FIG. 13 is a sectional view taken through section 13-13 of FIG. 12.
Figure 11:
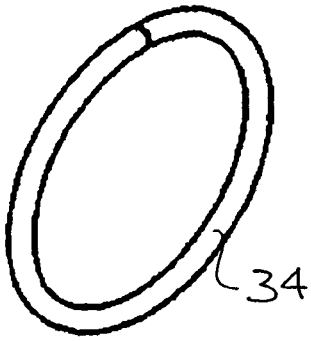
FIG. 11 is an isometric view of a braze ring which may be used during assembly of a cutting bit in accordance with an embodiment of the present invention.
Figure 12:
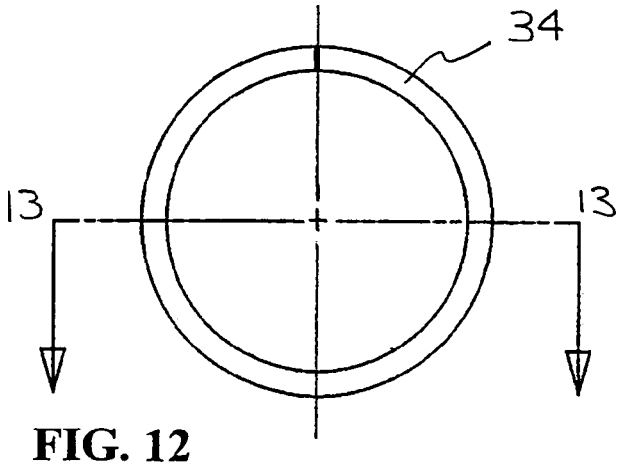
FIG. 12 is a front view of the braze ring of FIG. 11.

FIGS. 8-10 illustrate details of the retainer ring 32, and FIGS. 11-13 illustrate details of the braze ring 34. As shown in FIGS. 4 and 8-13, the retainer ring 32 has an inner diameter less than or equal to the outer diameter $R_{OD}$ of the split wear ring 30. The braze ring 34 has an inner diameter equal to or slightly smaller than the outer diameter of the nose 14 of the body 12. The inner diameter of the braze ring 34 is typically smaller than the inner diameter of the retainer ring 32 and the outer diameter $R_{OD}$ of the split wear ring 30. As shown most clearly in FIG. 4, the retainer ring 32 is seated against the rearward portion of the split wear ring 30 at the rear edge of the annular channel 19. The braze ring 34 is seated against the forward portion of the split wear ring 30 and the forward edge of the annular channel 19. The beveled cross sectional shape of the split wear ring 30 helps maintain the retainer ring 32 and braze ring 34 in their respective positions shown in FIG. 4.

In addition to the split wear rings 30 of the present invention, additional ribs, flutes, veins and/or dimples may be attached to the tool body 12 either independently or in conjunction with the split wear ring 30. The ribs, flutes, veins and/or dimples may be harder than the steel body 12, and may be made from similar materials as the split wear ring 30. Such ribs, flutes, veins and/or dimples may be used to protect the steel body 12 from erosion, e.g., caused by cutting of asphalt material, and to aid in rotation of the tool.

The retainer ring 32 holds the split wear ring segments 30*a* in place when going through the braze coil or other brazing operations. The wear ring segments 30*a* will tend to move apart by the magnetic action of the braze coil and the floating effect of the braze material if not held in place by the retainer ring. This aids in assembly. Operators do not need to hold the wear ring segments 30*a* together while the braze ring 34 melts, which avoids safety issues associated with operators placing their hands in the braze coil. During the cutting operations, the retainer ring 32 may be removed in the milling cut after a few minutes, and will not interfere with tool cutting performance.

The braze ring 34 snaps over the nose 14 of steel body 12 allowing easier assembly operation with the split wear ring segments 30*a*. The braze ring 34 helps lock down the split wear ring segments 30*a* to the body shoulder to prevent the rings from moving in the braze coil. Thus, both the braze ring 34 and retainer ring 32 may help secure the split wear ring segments during assembly. The braze material flows down behind the split wear ring segments 30*a* into the annular channel 19 to ensure better braze coverage and a more secure braze joint.

Comparative wear tests were performed on a cutting bit in accordance with an embodiment of the present invention in comparison with a conventional cutting bit having hard facing material deposited thereon and another cutting bit having a relatively large unitary wear ring. The comparative wear testing was performed by installing tools equally across an entire cutting drum so all tools are subject to similar wear and cutting conditions. The cutting drum was engaged in the material, e.g., asphalt, under normal job site cutting conditions across the full length of the cutting drum to ensure all tools are subject to the same wear pattern and conditions across the entire drum cutting surface. All parts were run in the asphalt material for the same amount of time or square footage. The parts were then removed from the cutting drum and examined and photographed to determine differences in wear.

Figure 14:
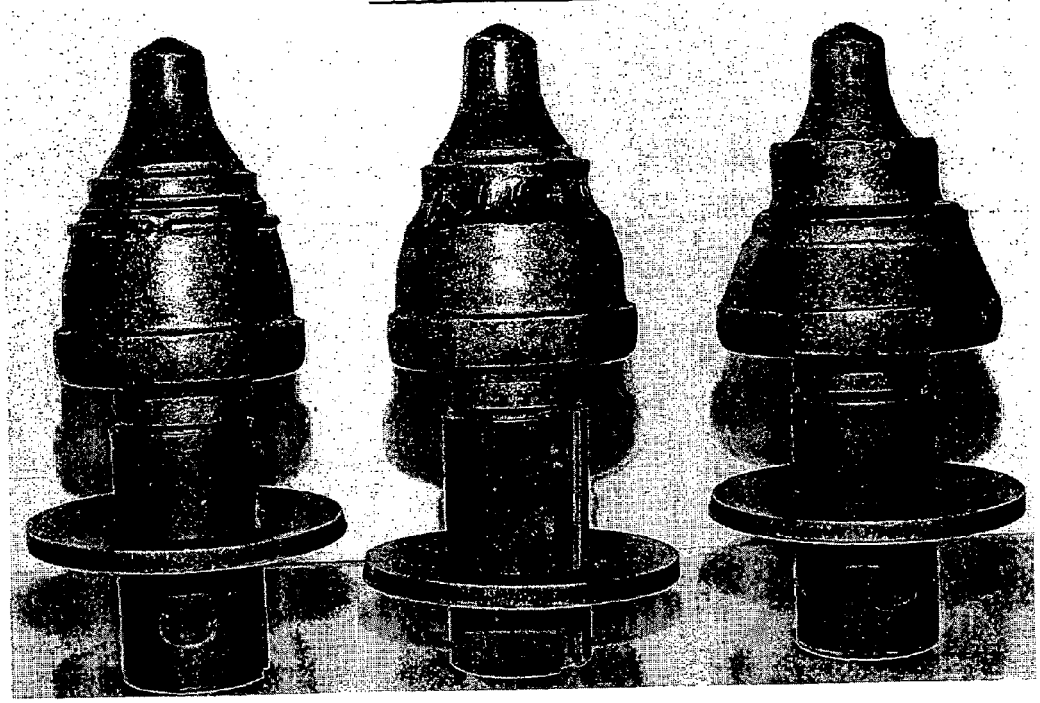
FIGS. 14 and 15 are photographs of different cutting bits before and after they were subjected to wear testing. In each of the photographs, a cutting bit in accordance with an embodiment of the present invention is shown on the left, a cutting bit with a deposited hard facing material is shown in the middle, and a cutting bit with a relatively large unitary wear ring is shown on the right.
Figure 15:
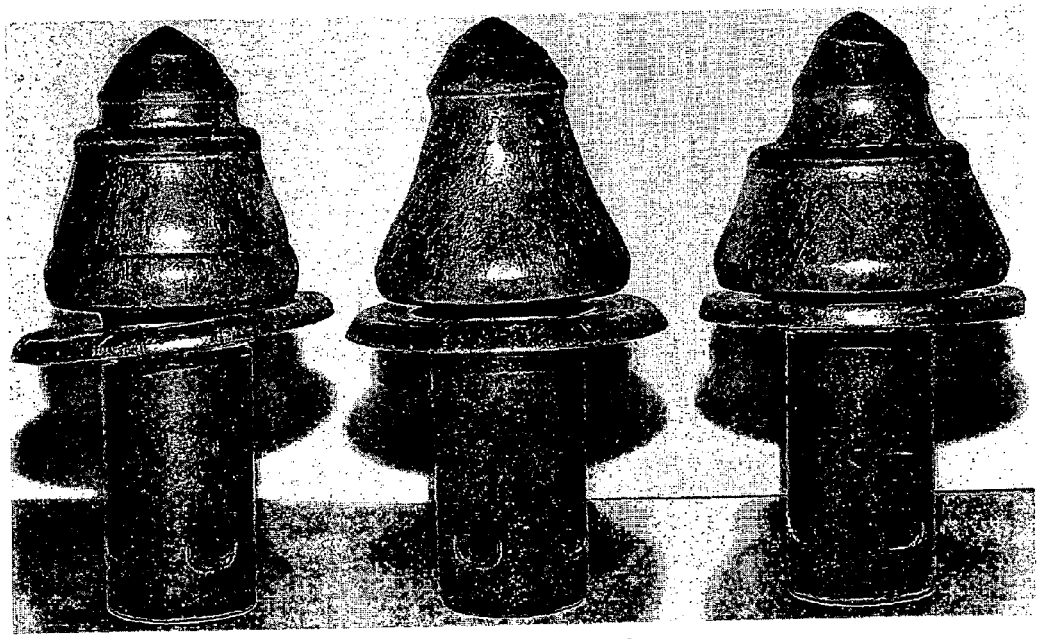
Figure 16:
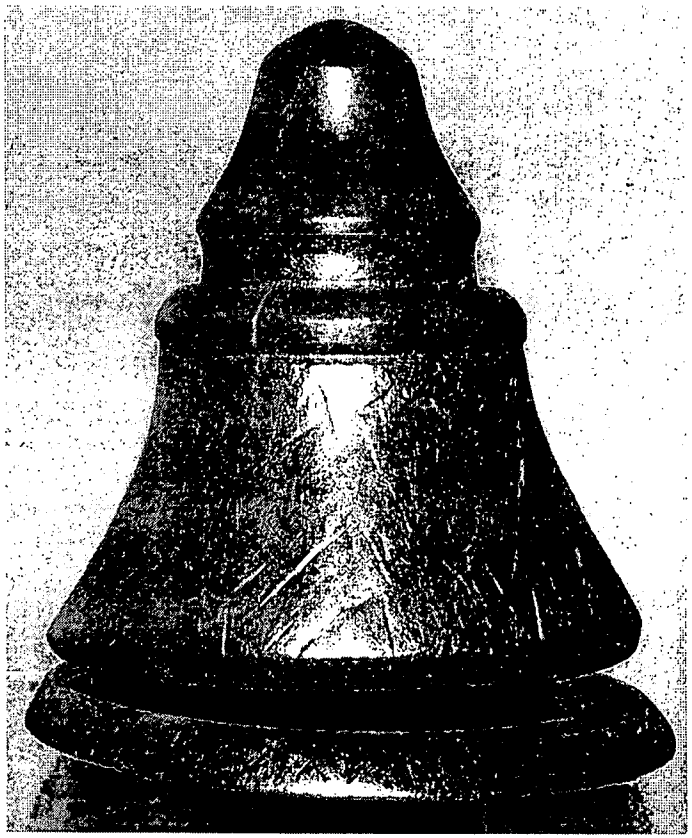
FIG. 16 is a photograph of a cutting bit in accordance with an embodiment of the present invention after it was subjected to wear testing.
Figure 17:
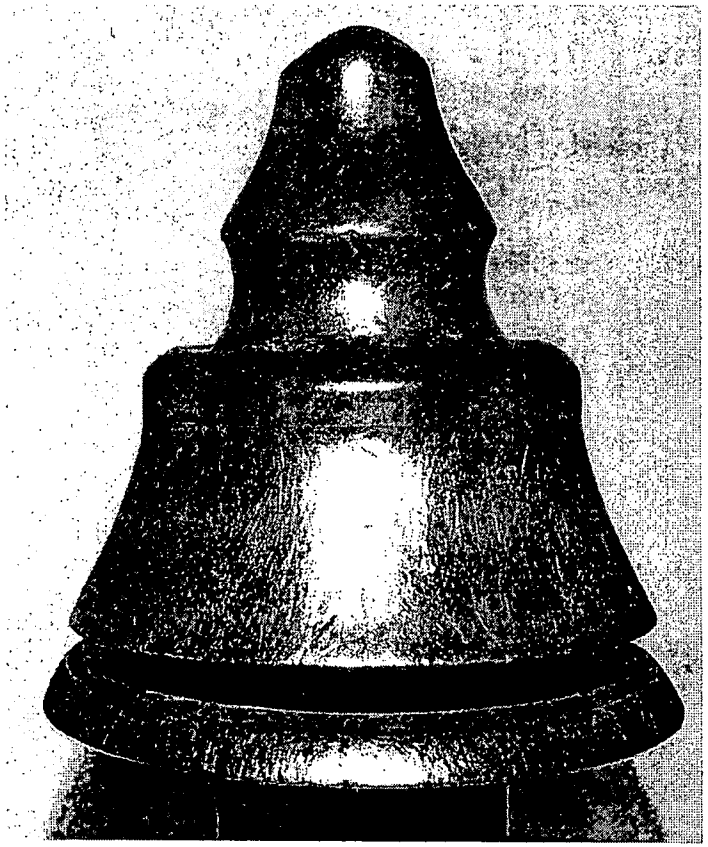
FIG. 17 is a photograph of a conventional single ring body wear protection cutting bit after it was subjected to wear testing.

FIG. 14 is a photograph showing the cutting bits before they were tested, and FIG. 15 is a photograph showing the cutting bits after they were subjected to wear testing. FIG. 16 is a photograph of a cutting bit of the present invention after it was subjected to wear testing. FIG. 17 is a photograph of a conventional single ring body wear protection cutting bit after it was subjected to wear testing.

Whereas particular embodiments of this invention have been described above for purposes of illustration, it will be evident to those skilled in the art that numerous variations of the details of the present invention may be made without departing from the invention as defined in the appended claims.

The invention claimed is:

1. A cutting bit comprising:

a body having a nose and a shank;

a cutting tip mounted on the nose of the body comprising a harder material than the body; and a split wear ring mounted in an annular channel in the body adjacent the nose comprising a harder material than the body, wherein the split wear ring has an inner diameter less than an outer diameter of the cutting tip and comprises at least two sections.

2. The cutting bit of claim 1, wherein the annular channel has a front wall and a rear wall defining a width of the channel, and the width of the channel is greater than or equal to an axial distance between the front wall of the annular channel and a front surface of the nose.

3. The cutting bit of claim 2, wherein the split wear ring has a thickness measured in an axial direction of the split wear ring greater than or equal to the axial distance between the front wall of the annular channel and the front surface of the nose.

4. The cutting bit of claim 2, wherein the cutting tip is mounted in a pocket in the nose and the pocket extends axially from the front surface of the nose into the body to a position beyond the front wall of the channel.

5. The cutting bit of claim 4, wherein the pocket extends axially into the body to a position between the front and back walls of the channel.

6. The cutting bit of claim 1, wherein the annular channel has a rear wall which meets the body of the cutting bit at an edge defining a shoulder, and the shoulder has a diameter greater than an outer diameter of the split wear ring.

7. The cutting bit of claim 1, wherein the split wear ring comprises two sections.

8. The cutting bit of claim 1, wherein the split wear ring comprises sections which are symmetrical with respect to each other in a plane defined by the split wear ring.

9. The cutting bit of claim 1, where the split wear ring has a cross section with bevelled edges.

10. The cutting bit of claim 9, wherein the cross section has four of the bevelled edges.

11. The cutting bit of claim 10, wherein all of the bevelled edges have substantially the same bevel angle.

12. The cutting bit of claim 11, wherein the bevel angle is about 45 degrees.

13. The cutting bit of claim 1, wherein adjacent sections of the split wear ring contact each other at abutting faces.

14. The cutting bit of claim 13, wherein the abutting faces are substantially flat.

15. The cutting bit of claim 13, wherein the abutting faces are contoured.

16. The cutting bit of claim 1, further comprising a retainer ring surrounding at least a portion of the split wear ring.

17. A cutting bit comprising:

a body having a nose and a shank;

a cutting tip mounted on the nose of the body comprising a harder material than the body;

a split wear ring comprising at least two sections mounted on the body adjacent the nose comprising a harder material than the body; and a retainer ring surrounding at least a portion of the split wear ring.

18. The cutting bit of claim 17, wherein the split wear ring has an inner diameter less than an outer diameter of the cutting tip.

19. The cutting bit of claim 17, wherein the split wear ring is mounted in an annular channel in the body.

20. The cutting bit of claim 19, wherein the retainer ring is located at least partially in the annular channel.

21. The cutting bit of claim 19, wherein the annular channel has a front wall and a rear wall defining a width of the channel, and the width of the channel is greater than or equal to an axial distance between the front wall of the channel and a front surface of the nose.

22. The cutting bit of claim 21, wherein the split wear ring has a thickness measured in an axial direction of the split wear ring greater than or equal to the distance between the front surface of the nose and the front wall of the annular channel.

23. The cutting bit of claim 21, wherein the cutting tip is mounted in a pocket in the nose and the pocket extends axially into the body beyond the front wall of the channel.

24. The cutting bit of claim 23, wherein the pocket extends axially into the body to a position between the front and back walls of the channel.

25. The cutting bit of claim 19, wherein the annular channel has a rear wall which meets the body of the cutting bit at an edge defining a shoulder, and the shoulder has a diameter greater than an outer diameter of the split wear ring.

26. A cutting bit assembly comprising:

a body having a nose and a shank;

a cutting tip mounted on the nose of the body comprising a harder material than the body;

a split wear ring comprising at least two sections mounted in an annular channel in the body adjacent the nose comprising a harder material than the body; and a retainer ring surrounding at least a portion of the split wear ring for maintaining the split wear ring in the annular channel.

27. The cutting bit assembly of claim 26, wherein the retainer ring is located at least partially in the annular channel.

28. The cutting bit assembly of claim 26, further comprising a braze ring mounted adjacent the split wear ring and the annular channel.

29. A method of assembling a cutting bit comprising:

providing a body having a nose and a shank;

mounting a cutting tip on the nose of the body comprising a harder material than the body;

positioning a split wear ring comprising at least two sections in an annular channel in the body adjacent the nose comprising a harder material than the body; and securing the split wear ring in the annular channel.

30. The method of claim 29, wherein the split wear ring is secured in the annular channel with a retainer ring.

31. The method of claim 29, further comprising brazing the split wear ring in the annular channel.

32. The method of claim 29, further comprising mounting a braze ring adjacent the split wear ring and the annular channel.

33. The method of claim 32, further comprising melting the braze ring.

34. The method of claim 33, further comprising brazing the cutting tip on the nose.

35. The method of claim 34, wherein the steps of melting the braze ring and brazing the cutting tip on the nose are performed during a single melting operation.

36. A cutting bit comprising:

a body having a nose and a shank;

a cutting tip mounted on the nose of the body comprising a harder material than the body; and a split wear ring mounted in an annular channel in the body adjacent the nose comprising a harder material than the body, wherein the split wear ring has an inner diameter less than an outer diameter of the cutting tip, the annular channel has a rear wall which meets the body of the cutting bit at an edge defining a shoulder, and the shoulder has a diameter greater than an outer diameter of the split wear ring.

37. A cutting bit comprising:

a body having a nose and a shank;

a cutting tip mounted on the nose of the body comprising a harder material than the body; and a split wear ring mounted in an annular channel in the body adjacent the nose comprising a harder material than the body, wherein the split wear ring has an inner diameter less than an outer diameter of the cutting tip and has a cross section with four bevelled edges.

* * * * *